US009514686B2

(12) United States Patent
Lee et al.

(10) Patent No.: US 9,514,686 B2
(45) Date of Patent: Dec. 6, 2016

(54) ORGANIC LIGHT EMITTING DISPLAY DEVICE

(71) Applicant: LG Display Co., Ltd., Seoul (KR)

(72) Inventors: Young Shin Lee, Suwon-si (KR); Ho Jun Song, Seongnam-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/472,138

(22) Filed: Aug. 28, 2014

(65) Prior Publication Data

US 2015/0061981 A1 Mar. 5, 2015

(30) Foreign Application Priority Data

Aug. 30, 2013 (KR) ..... 10-2013-0104171

(51) Int. Cl.
*G09G 3/32* (2016.01)

(52) U.S. Cl.
CPC .... *G09G 3/3291* (2013.01); *G09G 2300/0842* (2013.01); *G09G 2300/0861* (2013.01)

(58) Field of Classification Search
CPC ..... G09G 3/3291; G09G 2300/0842; G09G 2300/0861; G09G 2320/043
See application file for complete search history.

(56) References Cited

U.S. PATENT DOCUMENTS 8,274,503 B2 * 9/2012 Kwon ..... G09G 3/3233 345/214
9,035,976 B2 * 5/2015 Lee ..... G09G 3/3283 345/691
9,041,633 B2 * 5/2015 Park ..... H05B 33/0896 345/82
2009/0051628 A1 2/2009 Kwon
2009/0184901 A1 7/2009 Kwon
2009/0184903 A1 7/2009 Kwon
(Continued)

FOREIGN PATENT DOCUMENTS

CN 101354864 A 1/2009
CN 101373578 A 2/2009
(Continued)

OTHER PUBLICATIONS

Office Action for Chinese Patent Application No. CN 201410441430.7, Apr. 6, 2016, 13 Pages.

*Primary Examiner* — Abbas Abdulselam
(74) *Attorney, Agent, or Firm* — Fenwick & West LLP

(57) ABSTRACT

Disclosed is an organic light emitting display device which is capable of rapidly sensing a characteristic variation in a pixel including an organic light emitting diode and a driving transistor. The organic light emitting display device may include a display panel including a pixel formed adjacent to each crossing area of gate and data lines, and a sensing line provided in parallel to the data line and connected with the pixel. The device includes a data driver provided with a sensing data generator for sensing a characteristic variation of the pixel through the sensing line and generating sensing data based on the characteristic variation of the pixel for a sensing mode. The sensing data generator generates the sensing data for the pixel by converting current flowing from the pixel to the sensing line into voltage, and converting the voltage to a digital representation using an analog-to-digital conversion method.

15 Claims, 7 Drawing Sheets

(56) References Cited

U.S. PATENT DOCUMENTS

| | | | |
|---|---|---|---|
| 2009/0309818 | A1 | 12/2009 | Kim |
| 2010/0253608 | A1 | 10/2010 | Kim et al. |
| 2013/0147694 | A1 | 6/2013 | Kim et al. |

FOREIGN PATENT DOCUMENTS

| | | | |
|---|---|---|---|
| CN | 101488319 | A | 7/2009 |
| CN | 101488320 | A | 7/2009 |
| KP | 10-2013-0060476 | A | 6/2013 |
| KR | 20090129336 | A | 12/2009 |
| KR | 20100110060 | A | 10/2010 |
| KR | 10-2013-0030598 | A | 3/2013 |
| KR | 10-2013-0066449 | A | 6/2013 |

* cited by examiner

ORGANIC LIGHT EMITTING DISPLAY DEVICE

CROSS REFERENCE TO RELATED APPLICATIONS

This application claims the benefit of the Korean Patent Application No. 10-2013-0104171 filed on Aug. 30, 2013, which is hereby incorporated by reference as if fully set forth herein.

BACKGROUND

Field of the Disclosure

Embodiments of the present disclosure relate to an organic light emitting display device, and more particularly, to an organic light emitting display device which is capable of rapidly sensing a characteristic variation in a pixel including an organic light emitting diode and a driving transistor.

Discussion of the Related Art

An organic light emitting display device includes an organic light emitting layer which emits light by recombination of hole and electron, whereby the organic light emitting display device emits light in itself. Also, since the organic light emitting display device emits light in itself, there is no problem related with a viewing angle. In addition, the organic light emitting display device has advantages of rapid response speed and low power consumption. In this respect, the organic light emitting display device has been attracted as a next-generation flat panel display.

The organic light emitting display device may include a plurality of pixels for displaying images. Each pixel may include an organic light emitting diode having an organic light emitting layer between anode and cathode electrodes, and a pixel circuit for making the organic light emitting diode emit light. The pixel circuit may include a switching transistor, a driving transistor, and a capacitor. As the switching transistor is driven (e.g., switched) by a gate signal, the switching transistor supplies a data voltage to the driving transistor. As the driving transistor is driven (e.g., switched) by the data voltage supplied from the switching transistor, the driving transistor controls a current flowing to the organic light emitting diode, and also controls a light emission of the organic light emitting diode. The capacitor stores charge responsive to a voltage between gate and source terminals of the driving transistor, and drives (e.g., switches) the driving transistor by the use of stored voltage. The organic light emitting diode emits light by the current supplied from the driving transistor.

In the organic light emitting display device according to the related art, a characteristic variation of the driving transistor such as variations in mobility and threshold voltage (Vth) of the driving transistor may occur in each pixel due to a manufacturing deviation, whereby an amount of current for driving the organic light emitting diode may vary, and thus a luminance deviation may occur between each of pixels. In order to overcome this problem, the Unexamined Publication Number P10-2013-0066449 in the Korean Intellectual Property Office (hereinafter, referred to as 'prior art document') discloses an external compensation technique for compensating the characteristic variation of pixel by sensing the characteristic variation of pixel and reflecting the sensing result on data of the pixel.

In the above-mentioned prior art document, as shown in FIGS. 1 and 2, a data line connected with each pixel (P) is used as a sensing line 11, the sensing line 11 is charged with the current flowing in the driving transistor of the pixel (P), a voltage (Vout) charged in the sensing line 11 is sensed by an analog-to-digital converter (ADC), and the current flowing in the driving transistor of the pixel (P) is analogized (e.g., indirectly estimated) based on the sensed voltage. That is, in case of the above-mentioned prior art document, the voltage is sensed by the analog-to-digital converter (ADC) of voltage sensing method without measuring the actual current, and then the current flowing in the driving transistor is analogized based on the sensed voltage. In other words, the sensed voltage is used as a proxy for the current through the driving transistor.

However, in the above-mentioned prior art document, a sensing time (Tsen) for the sensing line 11 is increased due to large parasitic resistance (Rp) and large parasitic capacitance (Cp) of the sensing line 11; a sensing time (Tsen) for sensing a small current value corresponding to a low grayscale value is especially prolonged or increased. Also, the parasitic resistance (Rp) and parasitic capacitance (Cp) vary depending on a position of the sensing line 11, thereby causing errors in the sensing voltage. In case of the above-mentioned prior art document, since the data line, which is connected with both the organic light emitting diode and a source electrode of the driving transistor, is also used as the sensing line 11, undesired emissions of the organic light emitting diode occur in the low grayscale, which results in lowering of contrast ratio due to the increased luminance of low grayscale.

SUMMARY

Accordingly, embodiments of the present disclosure are directed to an organic light emitting display device that substantially obviates one or more problems due to limitations and disadvantages of the related art.

An aspect of embodiments of the present disclosure is directed to providing an organic light emitting display device which is capable of rapidly sensing a characteristic variation in a pixel including an organic light emitting diode and a driving transistor.

Additional advantages and features of embodiments of the disclosure will be set forth in part in the description which follows and in part will become apparent to those having ordinary skill in the art upon examination of the following or may be learned from practice of these embodiments. The objectives and other advantages of the disclosed embodiments may be realized and attained by the structures particularly pointed out in the written description and claims hereof as well as the appended drawings.

To achieve these and other advantages and in accordance with the purpose of the disclosed embodiments, as embodied and broadly described herein, there is provided an organic light emitting display device that may include a display panel including a pixel formed adjacent to each crossing area of gate and data lines, and a sensing line provided in parallel to the data line and connected with the pixel, and a data driver provided with a sensing data generator for sensing a characteristic variation of the pixel through the sensing line and generating sensing data based on the characteristic variation of the pixel for a sensing mode, wherein the sensing data generator generates the sensing data for the pixel by converting a current flowing from the pixel to the sensing line into a voltage, and converting the voltage in an analog-to-digital conversion method.

It is to be understood that both the foregoing general description and the following detailed description of disclosed embodiments are exemplary and explanatory and are intended to provide further explanation of the disclosure as claimed.

BRIEF DESCRIPTION OF THE DRAWINGS

The accompanying drawings, which are included to provide a further understanding of embodiments of the invention and are incorporated in and constitute a part of this application, illustrate embodiment(s) of the invention and together with the description serve to explain the principle of embodiments of the invention. In the drawings.

DETAILED DESCRIPTION

Reference will now be made in detail to the exemplary embodiments of the present disclosure, examples of which are illustrated in the accompanying drawings. Wherever possible, the same reference numbers will be used throughout the drawings to refer to the same or like parts.

With regard to the description of the embodiments of the present disclosure, the following details about various terms should be understood.

The term of a singular expression should be understood to include a multiple expression as well as the singular expression if there is no specific definition provided in the context of using the term. For example, when using a term such as "the first" or "the second", it is to separate any one element from other elements. Thus, a scope of claims is not limited by these terms.

Also, it should be understood that a term such as "include" or "have" does not preclude existence or possibility of one or more features, numbers, steps, operations, elements, parts or their combinations.

Hereinafter, an organic light emitting display device according to the disclosed embodiments will be described in detail with reference to the accompanying drawings.

Figure 3:
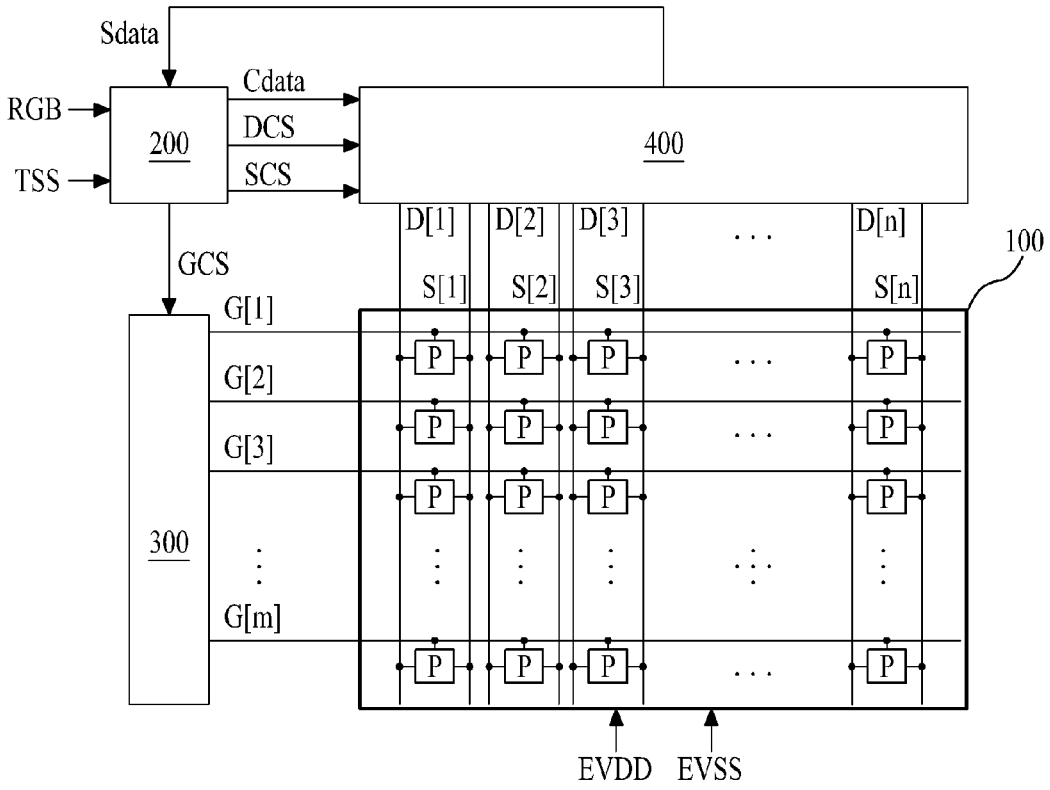
FIG. 3 illustrates an organic light emitting display device according to one embodiment.
Figure 4:
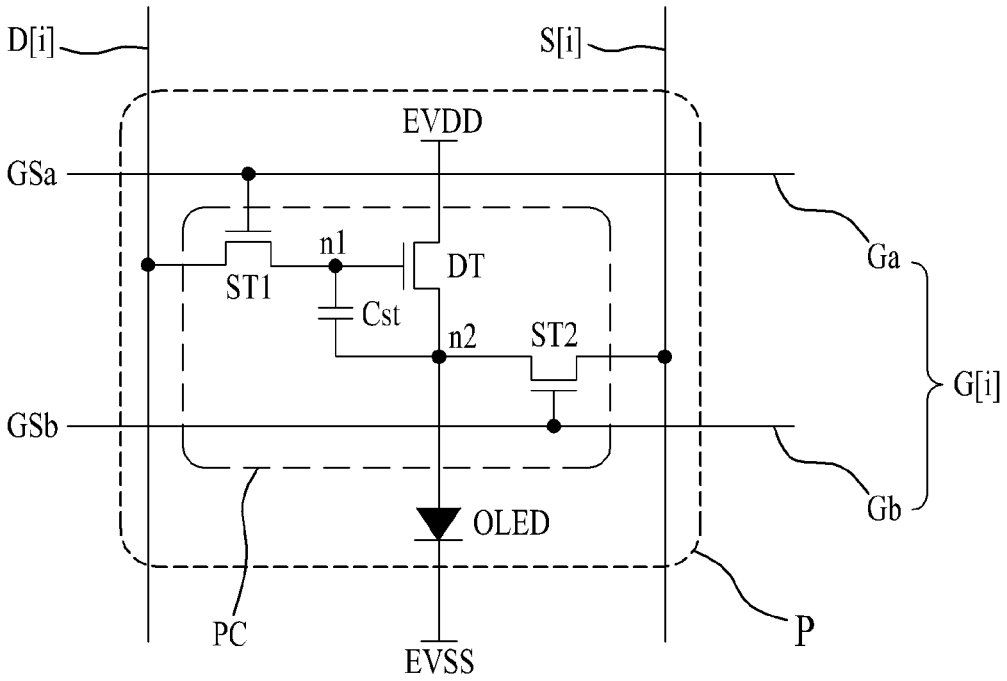
FIG. 4 illustrates a detailed view of the structure of each pixel shown in FIG. 3.

FIG. 3 illustrates an organic light emitting display device according to one embodiment. FIG. 4 illustrates a detailed view of the structure of each pixel shown in FIG. 3.

Referring to FIGS. 3 and 4, the organic light emitting display device according to the disclosed embodiment may include a display panel 100, a timing controller 200, a gate driver 300, and a data driver 400.

The display panel 100 may include a plurality of data lines (D[1] to D[n]), a plurality of gate lines (G[1] to G[m]), a plurality of sensing lines (S[1] to S[n]), and a plurality of pixels (P).

The plurality of data lines (D[1] to D[n]) are respectively provided at fixed intervals on the display panel 100. If the display panel 100 is driven in a display mode, the plurality of data lines (D[1] to D[n]) are used to supply a data voltage to the corresponding pixels (P). Meanwhile, if the display panel 100 is driven in a sensing mode, the plurality of data lines (D[1] to D[n]) are used to supply a sensing data voltage to the corresponding pixels (P).

The plurality of gate lines (G[1] to G[m]) are provided at fixed intervals on the display panel 100 and may be perpendicular to the plurality of data lines (D[1] to D[n]). Furthermore, as illustrated in FIG. 4, each of the gate lines (G[1] to G[m]) may include first and second gate signal lines (Ga, Gb).

The plurality of sensing lines (S[1] to S[n]) are provided at fixed intervals on the display panel 100 while being in parallel with the plurality of data lines (D[1] to D[n]). If the display panel 100 is driven in the display mode, the plurality of sensing lines (S[1] to S[n]) are used to supply a reference voltage to the corresponding pixels (P). Meanwhile, if the display panel 100 is driven in the sensing mode, the plurality of sensing lines (S[1] to S[n]) are used to sense a characteristic variation of the corresponding pixel (P). In this case, the characteristic variation of the pixel (P) may relate with or be caused by variations in a threshold voltage or mobility of a driving transistor (DT), or a deterioration of an organic light emitting diode over time.

Each of the pixels (P) may be any one among red, green, blue and white pixels. A unit pixel for displaying an image may include the red, green, blue and white pixels being adjacent to one another, but not necessarily, or may include the red, green and blue pixels being adjacent to one another.

Each of the pixels (P) is formed adjacent to each crossing area of the plurality of data lines (D[1] to D[n]), the plurality of gate lines (G[1] to G[m]) and the plurality of sensing lines (S[1] to S[n]), whereby each of the pixels (P) emits light by a data current corresponding to a differential voltage between the data voltage supplied from each of the data lines (D[1] to D[n]) and the reference voltage supplied from each of the sensing lines (S[1] to S[n]) in accordance with first and second gate signals (GSa, GSb; shown in FIG. 4) supplied to each of the gate lines (G[1] to G[m]), to thereby display an image. To this end, as illustrated in FIG. 4, each of the pixels (P) may include an organic light emitting diode (OLED) and a pixel circuit (PC).

The organic light emitting diode (OLED) emits light by the data current supplied from the pixel circuit (PC), and emits light with a luminance corresponding to the data current. To this end, the organic light emitting diode (OLED) may include an anode electrode (not shown) connected with the pixel circuit (PC), an organic layer (not shown) formed on the anode electrode, and a cathode electrode (not shown) supplied with a cathode voltage (EVSS) and formed on the organic layer. In this case, the organic layer may be formed by a deposition structure of a hole transport layer over an organic light emitting layer over an electron transport layer. Alternatively, a deposition structure for the organic layer may include a hole injection layer over a hole transport layer over an organic light emitting layer over an electron transport layer over an electron injection layer. Furthermore, the organic layer may include a functional layer for improving light-emitting efficiency and/or lifespan of the organic light emitting layer.

As shown in FIG. 4, the pixel circuit (PC) may include a scanning transistor (ST1), a sensing transistor (ST2), a driving transistor (DT), and a storage capacitor (Cst). In this case, the transistors (ST1, ST2, DT) may correspond to N-type transistor (TFT), for example, a-Si TFT, poly-Si TFT, Oxide TFT, Organic TFT, and the like.

The scanning transistor (ST1) may include a gate electrode connected with the first gate signal line (Ga), a first electrode connected with the adjacent data line (D[i]), and a second electrode connected with a first node (n1) corresponding to a gate electrode of the driving transistor (DT). The scanning transistor (ST1) supplies the data voltage supplied to the data line (D[i]) to the first node (n1) corresponding to the gate electrode of the driving transistor (DT) in accordance with a gate signal supplied to the first gate signal line (Ga).

The sensing transistor (ST2) may include a gate electrode connected with the second gate signal line (Gb), a first electrode connected with a second node (n2) corresponding to a source electrode of the driving transistor (DT), and a second electrode connected with the adjacent sensing line (S[i]). The sensing transistor (ST2) is switched by a gate signal supplied to the second gate signal line (Gb), whereby the sensing line (S[i]) is connected with the second node (n2) corresponding to the source electrode of the driving transistor (DT). Also, the sensing transistor (ST2) connects the second node (n2) of the corresponding pixel (P) with the sensing line (S[i]) for the sensing mode, whereby the current of the corresponding pixel (P) flows to the sensing line (S[i]) for the sensing mode.

The storage capacitor (Cst) includes first and second electrodes connected between the first and second nodes (n1, n2). The storage capacitor (Cst) is charged with a differential voltage between respective voltages supplied to the first and second nodes (n1, n2), and then switches the driving transistor (DT) in accordance with the charged voltage.

The driving transistor (DT) may include a gate electrode connected to both the second electrode of the scanning transistor (ST1) and the first electrode of the storage capacitor (Cst). The driving transistor (DT) may further include a source electrode connected with both the first electrode of the sensing transistor (ST2), the second electrode of the storage capacitor (Cst), and the anode electrode of the organic light emitting diode (OLED). The driving transistor (DT) may additionally include a drain electrode connected with a driving voltage (EVDD) line. The driving transistor (DT) is turned-on by the voltage of the storage capacitor (Cst), to thereby control an amount of current flowing from the driving voltage (EVDD) line to the organic light emitting diode (OLED).

Returning to FIG. 3, the timing controller 200 operates each of the gate driver 300 and the data driver 400 in accordance with the display mode, or operates each of the gate driver 300 and the data driver 400 in accordance with the sensing mode at user's preset time point or every preset time point for sensing the threshold voltage/mobility of the driving transistor (DT). The sensing mode may be operated for a test process before shipping manufactures of the organic light emitting display device, an initial driving process of the display panel 100, or at the end of a process of driving the display panel 100 for a long time; or may be operated in real time or every preset blank period of frame.

The timing controller 200 generates each of data control signal (DCS), gate control signal (GCS) and switch control signal (SCS) to drive each pixel (P) in accordance with the display mode or sensing mode on the basis of timing synchronized signal (TSS) input from the external, that is, body of system (not shown) or graphic card (not shown).

The timing controller 200 stores sensing data (Sdata) of each pixel (P), which is provided from the data driver 400 in accordance with the sensing mode, in a memory (not shown). For the display mode, the timing controller 200 corrects input data (RGB) on the basis of sensing data (Sdata) stored in the memory, and then provides correction data (Cdata) to the data driver 400.

As one example, if the unit pixel includes red, green and blue pixels, the timing controller 200 aligns input data (RGB) corresponding to red, green and blue color inputs in accordance with a pixel arrangement structure of the display panel 100. The timing controller 200 also corrects alignment data for each pixel on the basis of sensing data (Sdata) for each pixel stored in the memory, and provides correction data (Cdata) for each pixel to the data driver 400.

As another example, if the unit pixel includes red, green, blue, and white pixels, the timing controller 200 converts 3-color input data (RGB) corresponding to red, green and blue color inputs into 4-color data of corresponding to red, green, blue, and white colors in accordance with a pixel arrangement structure of the display panel 100. The timing controller 200 also corrects the 4-color data on the basis of sensing data (Sdata) stored in the memory, and provides correction data (Cdata) to the data driver 400. In this case, the timing controller 200 may include a 4-color data converter (not shown) for converting 3-color input data (RGB) into 4-color data of red, green, blue and white colors in accordance with a conversion method disclosed in the Unexamined Publication Number P10-2013-0060476 or P10-2013-0030598 in the Korean Intellectual Property Office.

The gate driver 300 sequentially generates the first and second gate signals (GSa, GSb) in accordance with the gate control signal (GCS) supplied from the timing controller 200, and then sequentially supplies the generated first and second gate signals (GSa, GSb) to the plurality of gate lines (G[1] to G[m]). The gate driver 300 may include a shift register for sequentially generating the first and second gate signals (GSa, GSb). The shift register may be formed in a semiconductor chip, and the shift register may be connected with the display panel 100 or provided on one side or both sides of the display panel 100 for a transistor manufacturing process for forming each pixel (P).

Figure 5:
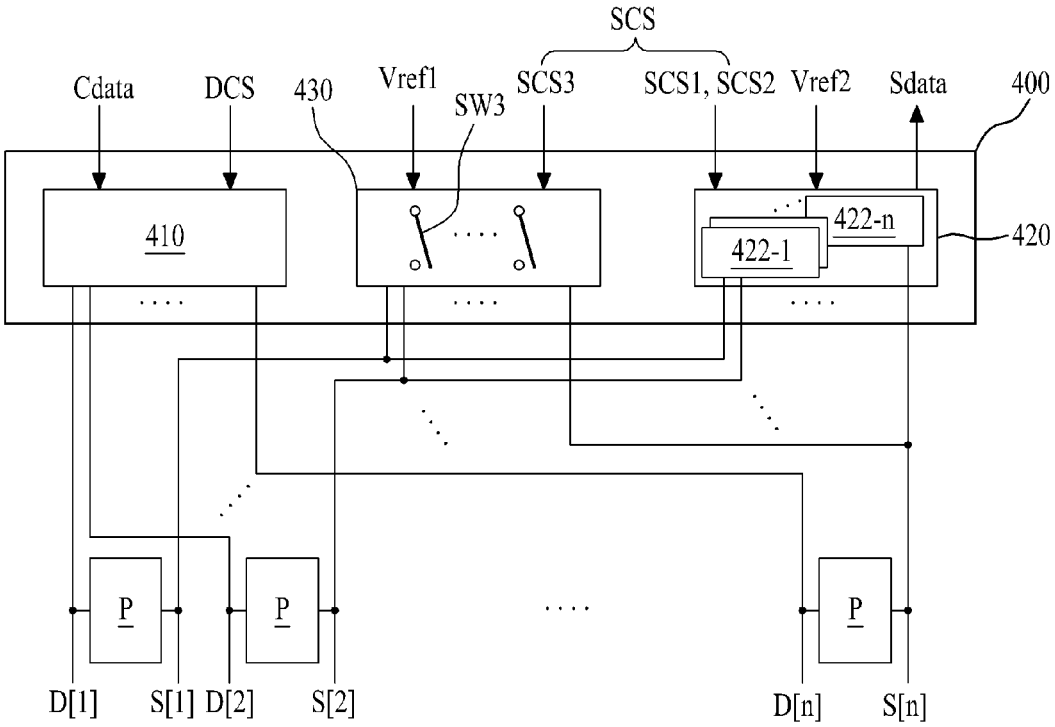
FIG. 5 illustrates a detailed view of the data driver shown in FIG. 3.

The data driver 400 converts the correction data (Cdata), which is input in response to the control of the timing controller 200 in accordance with the display mode, into the data voltage of analog type, and supplies the data voltage to the corresponding data line (D[1] to D[n]) and simultaneously supplies displaying reference voltage to the corresponding sensing line (S[1] to S[n]). In response to the control of the timing controller 200 in accordance with the sensing mode, especially, the data driver 400 senses the current flowing in each pixel (P) by a current sensing method, generates sensing data (Sdata) in accordance with the characteristic variation of each pixel (P) based on the sensed current, and supplies the generated sensing data (Sdata) to the timing controller 200. To this end, as shown in FIG. 5, the data driver 400 may include a data voltage supplier 410 for supplying the data voltage (corresponding to correction data or sensing data voltage) to each of the data lines (D[1] to D[n]) in accordance with the driving mode. The data driver 400 may also include a sensing data generator 420 for sensing the characteristic variation of each pixel (P) through each of the sensing lines (S[1] to S[n]) during the sensing mode, and generating the sensing data (Sdata) based on the sensed characteristic variation of each pixel (P). The data driver 400 may additionally include a reference voltage supplier 430 for supplying the displaying reference voltage (Vref1) to each of the sensing lines (S[1] to S[n]) during the displaying mode.

The data voltage supplier 410 is operated in response to the control of the timing controller 200, to thereby supply the data voltage to the data lines (D[1] to D[n]). The data voltage supplier 410 may include a shift register unit (not shown), a latch unit (not shown), and a digital-to-analog conversion unit (not shown). The shift register unit shifts a source start signal of the data control signal (DCS) in accordance with a source shift clock through the use of source shift clock and source start signal of the data control signal (DCS), and sequentially outputs a sampling signal. The latch unit sequentially samples and latches the correction data (Cdata) which is input in accordance with the sampling signal, and simultaneously outputs latch data of one horizontal line in accordance with a source output enable signal of the data control signal (DCS). The digital-to-analog conversion unit selects a grayscale voltage corresponding to a grayscale value of the latch data among a plurality of grayscale voltages supplied from a grayscale voltage generator (not shown), uses the selected grayscale voltage as the data voltage, and outputs the selected grayscale voltage to the data lines (D[1] to D[n]). The data voltage supplier 410 supplies the data voltage corresponding to the correction data (Cdata) to the data line (D[1] to D[n]) for the display mode, and supplies the preset sensing data voltage to the data line (D[1] to D[n]) for the sensing mode.

For the sensing mode, the sensing data generator 420 converts the current flowing from each pixel (P) to the corresponding sensing line (S[1] to S[n]) into a sensing voltage, and generates sensing data (Sdata) for each pixel (P) by an analog-to-digital conversion of the sensing voltage. To this end, the sensing data generator 420 may include a plurality of sensing units 422-1 to **422-*n* respectively connected with the plurality of sensing lines (S[1**] to S[n]).

Figure 6:
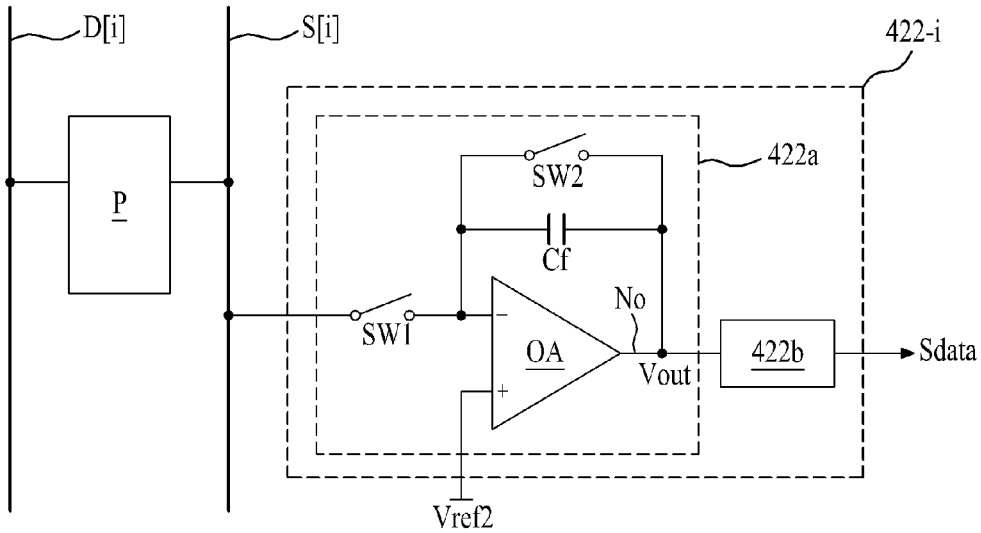
FIG. 6 illustrates a sensing unit of a sensing data generator, shown in FIG. 5, according to one embodiment.

As shown in FIG. 6, each of the sensing units 422-1 to **422-*n* may include a current-to-voltage converter 422*a* and an analog-to-digital converter 422*b***.

For the sensing mode, the current-to-voltage converter **422*a* converts the current flowing from each pixel (P) to the corresponding sensing line (S[1] to S[n]) into the voltage (Vout). To this end, the current-to-voltage converter 422*a* may include an operating amplifier (OA), a first switch (SW1), a second switch (SW2**), and a feedback capacitor (Cf).

The operating amplifier (OA) may include an inverting terminal (−), a non-inverting terminal (+), and an output terminal (No). The inverting terminal (−) is selectively connected with the sensing line (S[i]), and the output terminal (No) is connected with the analog-to-digital converter **422*b*. The non-inverting terminal (+) is supplied with a sensing reference voltage (Vref2). In this case, a direct current voltage (DC voltage) level of the sensing reference voltage (Vref2) may be the same as that of the displaying reference voltage (Vref1, illustrated in FIG. 5**), but not necessarily. That is, the DC voltage level of the sensing reference voltage (Vref2) may be different from that of the displaying reference voltage (Vref1).

If the first switch (SW1) is switched on or closed, responsive to a first switch signal (SCS1, as illustrated in FIG. 5) of the switch control signal (SCS) supplied from the timing controller 200, then the first switch (SW1) connects the sensing line (S[i]) with the inverting terminal (−) of the operating amplifier (OA). In case of the sensing mode, the first switch (SW1) is turned-on for an initialization period (or reset period) of the sensing line (S[i]) and a sensing period of the sensing line (S[i]).

If the second switch (SW2) is switched on or closed by a second switch signal (SCS2, as illustrated in FIG. 5) of the switch control signal (SCS) supplied from the timing controller 200, then the second switch (SW2) connects the inverting terminal (−) of the operating amplifier (OA) with the output terminal (No). In case of the sensing mode, the second switch (SW2) is turned-on only for the initialization period.

The feedback capacitor (Cf) is connected between the output terminal (No) and inverting terminal (−) of the operating amplifier (OA). The feedback capacitor (Cf) is initialized to 0V (zero voltage) due to a short between the output terminal (No) and inverting terminal (−) of the operating amplifier (OA) when the second switch (SW2) is turned-on for the initialization period. The feedback capacitor (Cf) is charged with the current flowing from the pixel (P) to the sensing line (S[i]) in accordance with the turning-off state of the second switch (SW2) and the turning-on state of the first switch (SW1) for the sensing period, thereby changing the output voltage (Vout) which is provided to the output terminal (No) of the operating amplifier (OA).

The analog-to-digital converter **422*b* generates the sensing data (Sdata) through an analog-to-digital conversion of the output voltage (Vout) which is output from the current-to-voltage converter 422*a***.

Referring once again to FIG. 5, the reference voltage supplier 430 supplies the displaying reference voltage (Vref1) to the plurality of sensing lines (S[1] to S[n]) only for the display mode. To this end, the reference voltage supplier 430 may include a plurality of switching elements (SW3) which are switched by a third switch signal (SCS3) of the switch control signal (SCS) supplied from the timing controller 200 only for the display mode, and are operated to supply the displaying reference voltage (Vref1) to the plurality of sensing lines (S[1] to S[n]) only for the display mode.

Figure 7:
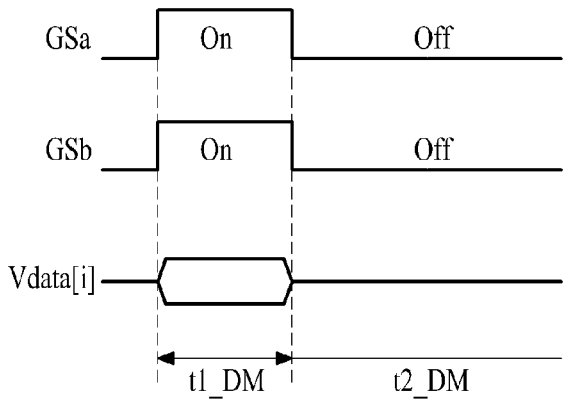
FIG. 7 is a waveform diagram illustrating a driving waveform of a pixel of the organic light emitting display device, during a display mode, according to one embodiment.

FIG. 7 is a waveform diagram illustrating a driving waveform of the pixel of the organic light emitting display device, during the display mode, according to one embodiment.

An operation of the i-th pixel (P[i]) connected with the i-th gate line (G[i]) for the display mode will be described as follows with reference to FIGS. 3, 4 and 7. Referring to FIG. 7, a display period of the display mode comprises a data charging period (t1_DM) and a light emitting period (t2_DM). Therefore, during the display mode, the i-th pixel (P[i]) is operated in a data charging period (t1_DM) and in a light emitting period (t2_DM).

First, the timing controller 200 supplies the correction data (Cdata), which is obtained by correcting the input data (RGB) on the basis of sensing data (Sdata) stored in the memory, to the data driver 400, and then controls the gate driver 300 and the data driver 400 in accordance with the data charging period (t1_DM) and the light emitting period (t2_DM).

For the data charging period (t1_DM), the first and second gate signals (GSa, GSb) of gate-on voltage level are respectively supplied to the first and second gate signal lines (Ga, Gb); the data voltage (Vdata[i]) corresponding to the correction data (Cdata) is supplied to the i-th data line (D[i]); and the displaying reference voltage (Vref1) is supplied to the i-th sensing line (S[i]). Accordingly, the scanning transistor (ST1) and the sensing transistor (ST2) are turned-on by the first and second gate signals (GSa, GSb), whereby the data voltage (Vdata[i]) is supplied to the first node (n1), and the displaying reference voltage (Vref1) is supplied to the second node (n2). For the data charging period (t1_DM), the storage capacitor (Cst) is charged with a differential voltage (Vdata[i]−Vref1) between the data voltage (Vdata[i]) and the displaying reference voltage (Vref1).

For the light emitting period (t2_DM), the first and second gate signals (GSa, GSb) of gate-off voltage level are respectively supplied to the first and second gate signal lines (Ga, Gb). Accordingly, the scanning transistor (ST1) and the sensing transistor (ST2) are turned-off by the first and second gate signals (GSa, GSb), whereby the driving transistor (DT) is turned-on by the voltage stored in the storage capacitor (Cst). Thus, the turned-on driving transistor (DT) supplies the data current, which is determined by the differential voltage (Vdata[i]−Vref1) between the data voltage (Vdata[i]) and the displaying reference voltage (Vref1), to the organic light emitting diode (OLED), to thereby make the organic light emitting diode (OLED) emit light. That is, when the scanning transistor (ST1) and the sensing transistor (ST2) are turned-off for the light emitting period (t2_DM), the current flows in the driving transistor (DT) in accordance with the driving voltage (EVDD), and the organic light emitting diode (OLED) starts to emit light in proportion to the current flowing in the driving transistor (DT). Thus, the voltage of the second node (n2) is raised so that the voltage of the first node (n1) is also raised in proportion to the raised voltage of the second node (n2). As a result, a gate-to-source voltage (Vgs) of the driving transistor (DT) is held constant and equal to the voltage across the storage capacitor (Cst), and the light emission of the organic light emitting diode (OLED) is maintained constant until the next data charging period (t1_DM).

For the display mode, the threshold voltage of the driving transistor (DT) for each pixel (P) is compensated by the data voltage corresponding to the correction data (Cdata) on which the sensing data (Sdata) is reflected.

Figure 8:
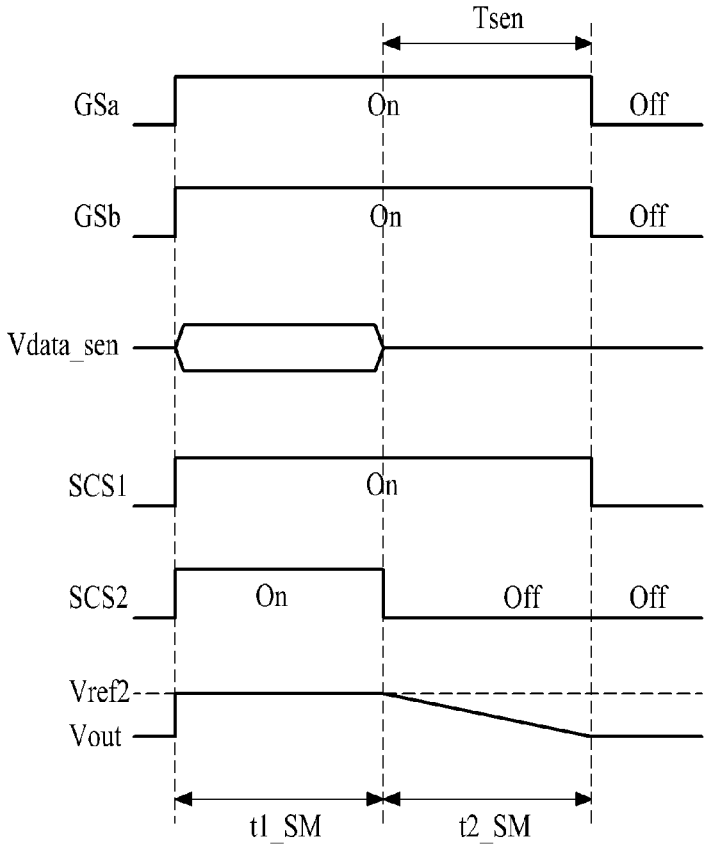
FIG. 8 is a waveform diagram illustrating a driving waveform of a pixel of the organic light emitting display device, during a sensing mode, according to one embodiment.
Figure 9A:
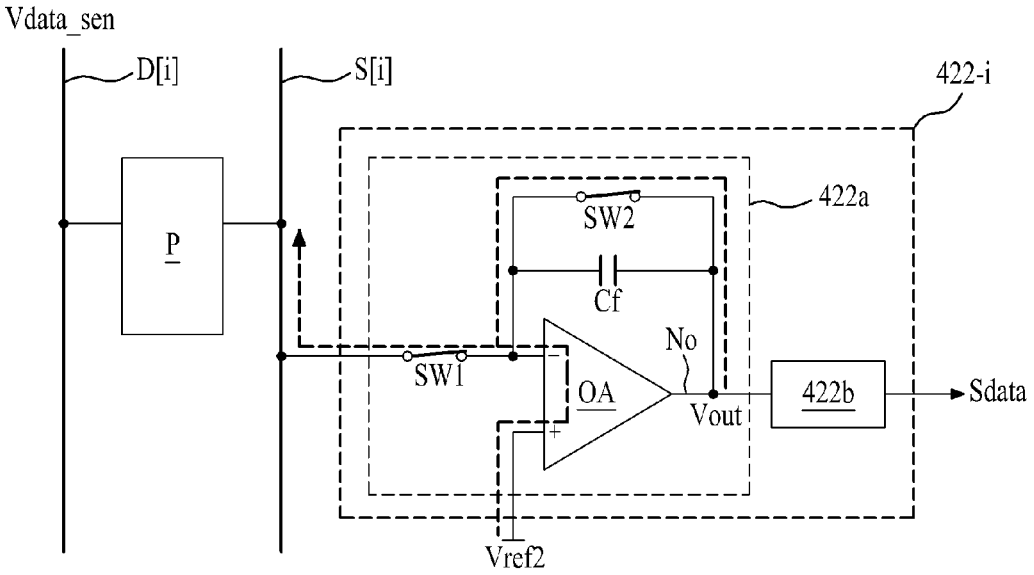
FIGS. 9A and 9B illustrate a sequential operation of the pixel in accordance with the driving waveform of the pixel shown in FIG. 8.
Figure 9B:
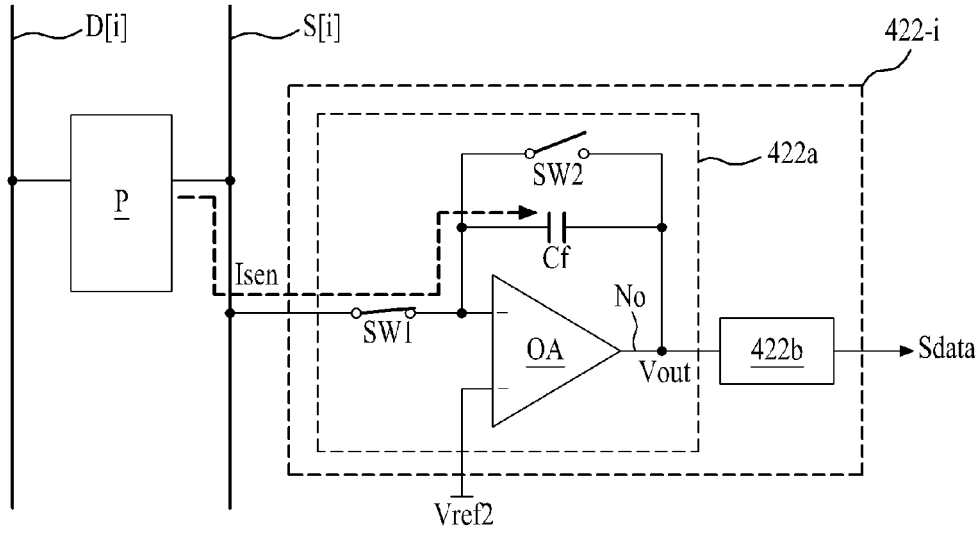

FIG. 8 is a waveform diagram illustrating a driving waveform of the pixel of the organic light emitting display device, during the sensing mode, according to one embodiment. FIGS. 9A and 9B illustrate a sequential operation of the pixel in accordance with the driving waveform of the pixel shown in FIG. 8. FIG. 9A corresponds to the operation of the pixel in the initialization period (t1_SM) of the sensing mode. FIG. 9B corresponds to the operation of the pixel in the sensing period (t2_SM or Tsen) of the sensing mode.

An operation of the i-th pixel (P[i]) connected with the i-th gate line (G[i]) for the sensing mode will be described as follows. Referring to FIG. 8, a sensing period of the sensing mode comprises an initialization period (t1_SM) and a sensing period (t2_SM or Tsen). Therefore, during the sensing mode, the i-th pixel (P[i]) is operated in an initialization period (t1_SM) and in a sensing period (t2_SM).

Referring to FIGS. 4, 5, 8, and 9A, for the initialization period (t1_SM), the first and second gate signals (GSa, GSb) of gate-on voltage level are respectively supplied to the first and second gate signal lines (Ga, Gb), and the sensing data voltage (Vdata_sen) is supplied to the i-th data line (D[i]). Also, data for the sensing mode, which is preset to sense the characteristic variation of the pixel (P), is supplied to the data voltage supplier 410 of the data driver 400 (as shown in FIG. 5), and the first and second switch signals (SCS1, SCS2) of switch-on voltage level are supplied to the sensing data generator 420 of the data driver 400 (also illustrated in FIG. 5). Accordingly, as described with reference to FIG. 4, the scanning transistor (ST1) and the sensing transistor (ST2) are turned-on by the first and second gate signals (GSa, GSb), whereby the data voltage (Vdata[i]) is supplied to the first node (n1), and the sensing reference voltage (Vref2) is supplied from the sensing data generator 420 of the data driver 400 to the second node (n2). Thus, for the initialization period (t1_SM), the storage capacitor (Cst) is charged with a differential voltage (Vdata_sen−Vref2) between the sensing data voltage (Vdata_sen) and the sensing reference voltage (Vref2). For the initialization period (t1_SM), the i-th sensing line (S[i]) is initialized to the sensing reference voltage (Vref2) by the current-to-voltage converter 422*a* included in the sensing unit 422-*i* of the sensing data generator 420, which will be described in detail as follows.

For the initialization period (t1_SM), the first and second switches (SW1, SW2) included in the current-to-voltage converter 422*a* are turned-on by the respective first and second switch signals (SCS1, SCS2) of switch-on voltage level. Accordingly, the output terminal (No) and inverting terminal (−) of the operating amplifier (OA) included in the current-to-voltage converter 422*a* are short-circuited with each other by the turned-on second switch (SW2), whereby the feedback capacitor (Cf) of the current-to-voltage converter 422*a* is initialized to 0V. Also, since the non-inverting terminal (+) of the operating amplifier (OA) is supplied with the sensing reference voltage (Vref2), the sensing reference voltage (Vref2) is supplied to the inverting terminal (−) which is connected with the non-inverting terminal (+) by a virtual ground, whereby the sensing reference voltage (Vref2) is also supplied to the output terminal (No) of the operating amplifier (OA) through the turned-on second switch (SW2). At the same time, the sensing line (S[i]) is charged with the sensing reference voltage (Vref2) through the turned-on first switch (SW1) at a high speed, whereby the sensing reference voltage (Vref2) charged in the sensing line (S[i]) is supplied to the second node (n2) through the turned-on sensing transistor (ST2).

Referring to FIGS. 4, 5, 8 and 9B, for the sensing period (t2_SM), the first and second gate signals (GSa, GSb) of gate-on voltage level are respectively supplied to the first and second gate signal lines (Ga, Gb); the first switch signal (SCS1) of switch-on voltage and the second switch signal (SCS2) of switch-off voltage are supplied to the sensing data generator 420 of the data driver 400 (as shown in FIG. 5); and the sensing data voltage (Vdata_sen) supplied to the i-th data line (D[i]) is stopped. When the scanning transistor (ST1), the sensing transistor (ST2) and the first switch (SW1) are maintained in the closed or on state, the inverting terminal (−) of the operating amplifier (OA) is connected with the source electrode of the driving transistor (DT) which is connected with the organic light emitting diode (OLED) through the first switch (SW1), the i-th sensing line (S[i]) and the sensing transistor (ST2). Also, according as the second switch (SW2) is turned-off, the output terminal (No) and inverting terminal (−) of the operating amplifier (OA) are electrically separated from each other so that the operating amplifier (OA) is operated as an integrator, whereby the current (Isen) flowing in the i-th sensing line (S[i]) is converted into the voltage. Thus, the driving transistor (DT) is turned-on by the voltage charged in the storage capacitor (Cst), and the feedback capacitor (Cf) connected with the operating amplifier (OA) is rapidly charged with the current (Isen) flowing in the turned-on driving transistor (DT) by the i-th sensing line (S[i]) previously charged with the sensing reference voltage (Vref2), whereby the output voltage (Vout) of the operating amplifier (OA) is linearly decreased in the sensing reference voltage (Vref2).

As the analog-to-digital converter 422*b* of the sensing data generator 420 converts the output voltage (Vout) of the operating amplifier (OA) by the analog-to-digital conversion just before the end of sensing period (t2_SM), the analog-to-digital converter 422*b* generates the sensing data (Sdata) corresponding to the current (Isen) flowing in the driving transistor (DT), and provides the generated sensing data (Sdata) to the timing controller 200.

Figure 10:
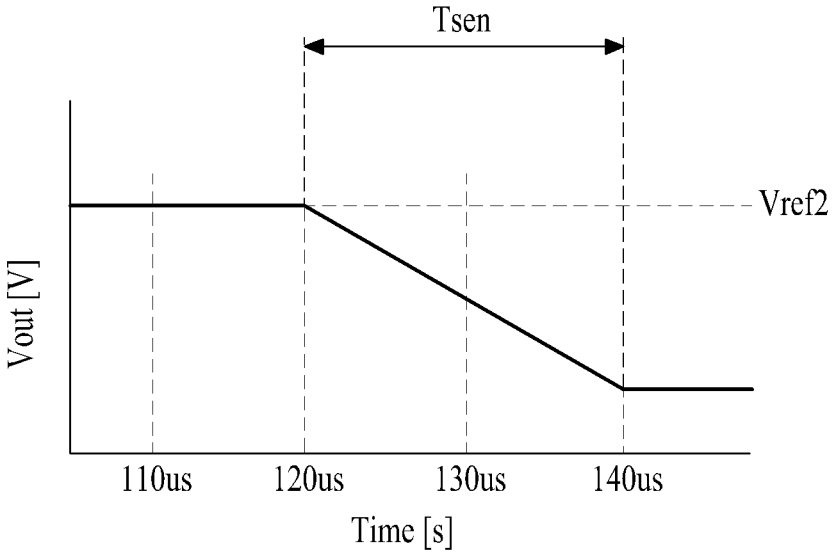
FIG. 10 is a waveform diagram illustrating a sensing time in the organic light emitting display device according to one embodiment.

FIG. 10 is a waveform diagram illustrating the sensing time (Tsen) in the organic light emitting display device according to the embodiment of the present invention.

Figure 1:
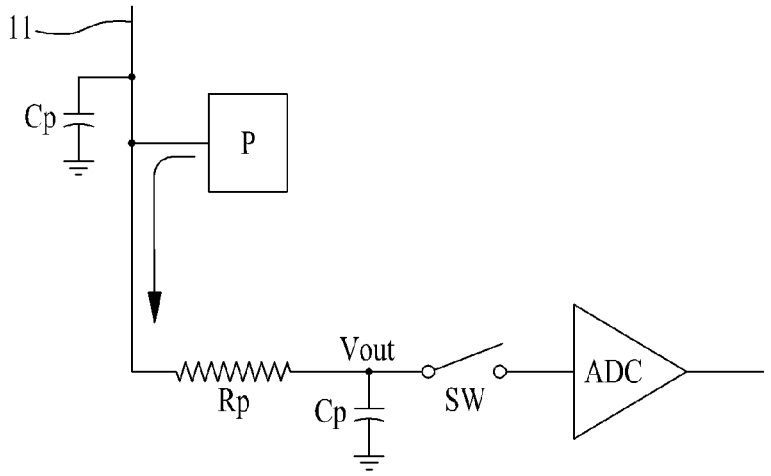
FIG. 1 Related Art
FIG. 1 illustrates a related art voltage sensing circuit.
Figure 2:
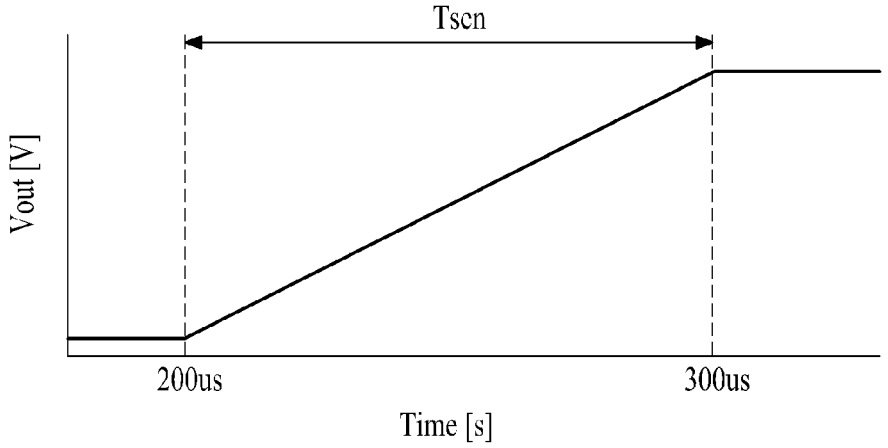
FIG. 2 Related Art
FIG. 2 is a waveform diagram illustrating a related art sensing time.

According to the present invention, as shown in FIG. 10, in case of the sensing mode, the sensing line is previously charged with the constant sensing reference voltage (Vref2), and the voltage is maintained substantially constant without change over the period of sensing the current flowing in the driving transistor (DT) of the virtual pixel (P) so that it is possible to reduce the sensing time (Tsen). While the related art sensing time shown in FIG. 2 is about 100 us, the sensing time (Tsen) of the present embodiments is reduced to about 20 us.

As described above, in case of the sensing mode according to the present disclosure, the current flowing from the driving transistor (DT) of the pixel (P) to the sensing line is sensed through the use of current-to-voltage converter for converting the current into the voltage so that the current flowing in the pixel (P) is sensed at a high speed. Also, the sensing line is previously charged with the constant sensing reference voltage (Vref2) so that it is possible to minimize sensing errors and delay of the sensing time caused by the parasitic resistance and parasitic capacitance of the sensing line.

According to the present disclosures, in case of the display mode, the sensing line, which is connected with the organic light emitting diode (OLED) and the source electrode of the driving transistor (DT) in common, is supplied with the displaying reference voltage (Vref1) instead of the data voltage so that it is possible to prevent lowering of the contrast ratio in the low grayscale.

It will be apparent to those skilled in the art that various modifications and variations can be made in the present embodiments without departing from the spirit or scope of the disclosure. Thus, it is intended that the present embodiments covers the modifications and variations of this disclosure provided they come within the scope of the appended claims and their equivalents.

What is claimed is:

1. An organic light emitting display device comprising:

a display panel including a plurality of pixels formed adjacent to crossing areas of a plurality of gate lines and, a plurality of data lines, and a plurality of sensing lines provided in parallel to the plurality of data lines, each sensing line, each gate line, and each data line connected with one or more pixels of the plurality of pixels; and a data driver provided with a sensing data generator for sensing a characteristic variation of a pixel through a corresponding sensing line, wherein the sensing data generator includes a sensing unit connected with the sensing line for generating sensing data based on the characteristic variation of the pixel during a sensing mode of the display device, wherein the sensing unit includes a current-to-voltage converter, which is connected with the sensing line, for converting a current from the pixel to the sensing line into a voltage and outputting the voltage, and an analog-to-digital converter for converting the output voltage of the current-to-voltage converter to a digital representation, and generating the sensing data for the pixel, and wherein the current-to-voltage converter includes:

an operating amplifier including an inverting terminal connected with the sensing line, a non-inverting terminal supplied with a sensing reference voltage, and an output terminal connected with the analog-to-digital converter, a feedback capacitor connected between the inverting terminal and the output terminal of the operating amplifier, a first switch, switched by a first switch signal, to connect or disconnect the sensing line with the inverting terminal of the operating amplifier, and a second switch, switched by a second switch signal, to connect or disconnect the inverting terminal of the operating amplifier with the output terminal of the operating amplifier.

2. The organic light emitting display device according to claim 1, wherein the pixel is operated in an initialization period and in a sensing period during the sensing mode of the display device, wherein the first and second switches are turned-on during the initialization period, and the first switch is turned-on during the sensing period and the second switch is turned-off during the sensing period.

3. The organic light emitting display device according to claim 2, wherein a voltage across the feedback capacitor is initialized to 0V by a short between the output terminal and the inverting terminal of the operating amplifier responsive to the second switch being turned-on during the initialization period, and wherein the sensing line is supplied with the sensing reference voltage through the turned-on first switch and the inverting terminal connected with the non-inverting terminal of the operating amplifier by a virtual ground during the initialization period.

4. The organic light emitting display device according to claim 2, wherein the current-to-voltage converter is operated as an integrator during the sensing period.

5. The organic light emitting display device according to claim 2, wherein the output voltage of the current-to-voltage converter is linearly decreased in the sensing reference voltage for the sensing period.

6. The organic light emitting display device according to claim 1, further comprising a timing controller for generating correction data by correcting input data based on the sensing data of the pixel, and supplying the generated correction data to the data driver, wherein the data driver further includes a data voltage supplier for converting the correction data into a data voltage and supplying the data voltage to a data line of the plurality of data lines during a display mode of the display device.

7. The organic light emitting display device according to claim 6, wherein the pixel is operated in a data charging period and in a light emitting period during the display mode, wherein the data driver further includes a reference voltage supplier for supplying a displaying reference voltage to the sensing line during the data charging period.

8. The organic light emitting display device according to claim 1, wherein the pixel includes an organic light emitting diode, and a pixel circuit for making the organic light emitting diode emit light, wherein the pixel circuit includes:

a driving transistor for controlling an amount of current flowing in the organic light emitting diode in accordance with a differential voltage between the data voltage supplied to a data line corresponding to the pixel and a displaying reference voltage supplied to the sensing line;

a scanning transistor for supplying the data voltage to a gate electrode of the driving transistor;

a sensing transistor, which is connected with the organic light emitting diode, for supplying the displaying reference voltage to a source electrode of the driving transistor; and a storage capacitor connected between the gate and source electrodes of the driving transistor.

9. An organic light emitting display device comprising:

a display panel including a pixel connected a gate line and, a data line, and a sensing line; and a data driver provided with a sensing data generator for sensing a characteristic variation of the pixel through the sensing line, wherein the sensing data generator includes a current-to-voltage converter connected with the sensing line an analog-to-digital converter for converting an output voltage of the current-to-voltage converter to the sensing data, wherein the current-to-voltage converter is operated as an integrator for converting a current from the pixel to the sensing line into the output voltage, and wherein the current-to-voltage converter includes:

an operating amplifier including an inverting terminal connected with the sensing line, a non-inverting terminal supplied with a sensing reference voltage, and an output terminal connected with the analog-to-digital converter, a feedback capacitor connected between the inverting terminal and the output terminal of the operating amplifier, a first switch, switched by a first switch signal, to connect or disconnect the sensing line with the inverting terminal of the operating amplifier, and a second switch, switched by a second switch signal, to connect or disconnect the inverting terminal of the operating amplifier with the output terminal of the operating amplifier.

10. The organic light emitting display device according to claim 9, wherein the pixel includes an organic light emitting diode, and a pixel circuit for making the organic light emitting diode emit light, wherein the pixel circuit includes:

a driving transistor for controlling an amount of current flowing in the organic light emitting diode;

a scanning transistor for supplying a data voltage to a gate electrode of the driving transistor;

a sensing transistor, which is connected with the organic light emitting diode, for supplying a displaying reference voltage supplied to the sensing line to a source electrode of the driving transistor; and a storage capacitor connected between the gate and source electrodes of the driving transistor.

11. The organic light emitting display device according to claim 10, wherein the pixel is operated in an initialization period and in a sensing period during the sensing mode of the display device, wherein the first and second switches are turned-on during the initialization period, and the first switch is turned-on during the sensing period and the second switch is turned-off during the sensing period.

12. The organic light emitting display device according to claim 11, wherein a voltage across the feedback capacitor is initialized to 0V by a short between the output terminal and the inverting terminal of the operating amplifier responsive to the second switch being turned-on during the initialization period, and wherein the sensing line is supplied with the sensing reference voltage through the turned-on first switch and the inverting terminal connected with the non-inverting terminal of the operating amplifier by a virtual ground during the initialization period.

13. The organic light emitting display device according to claim 11, wherein the output voltage of the current-to-voltage converter is linearly decreased in the sensing reference voltage for the sensing period.

14. The organic light emitting display device according to claim 9, further comprising a timing controller for generating correction data by correcting input data based on the sensing data of the pixel, and supplying the generated correction data to the data driver, wherein the data driver further includes a data voltage supplier for converting the correction data into a data voltage and supplying the data voltage to a data line of the plurality of data lines during a display mode of the display device.

15. The organic light emitting display device according to claim 14, wherein the pixel is operated in a data charging period and in a light emitting period during the display mode, wherein the data driver further includes a reference voltage supplier for supplying a displaying reference voltage to the sensing line during the data charging period.

* * * * *